US012778357B2

(12) United States Patent
Plumb

(10) Patent No.: US 12,778,357 B2
(45) Date of Patent: Nov. 3, 2026

(54) VERTICALLY ADJUSTABLE SUPPORT FOR A TOWEL OR OTHER DOMESTIC ARTICLE TO ACCOMMODATE A CHILD'S GROWTH IN HEIGHT

(71) Applicant: Diane Allison Plumb, Sunbury, OH (US)

(72) Inventor: Diane Allison Plumb, Sunbury, OH (US)

( * ) Notice: Subject to any disclaimer, the term of this patent is extended or adjusted under 35 U.S.C. 154(b) by 0 days.

(21) Appl. No.: 19/055,055

(22) Filed: Feb. 17, 2025

(65) Prior Publication Data

US 2026/0240374 A1 Aug. 20, 2026

(51) Int. Cl.

| | |
|---|---|
| ***A47K 10/10*** | (2006.01) |
| ***A47G 25/06*** | (2006.01) |
| ***A47K 10/12*** | (2006.01) |
| *A47F 5/08* | (2006.01) |
| *A47F 7/14* | (2006.01) |

(52) U.S. Cl.

CPC ..... *A47K 10/10* (2013.01); *A47G 25/0614* (2013.01); *A47K 10/12* (2013.01); *A47F 5/08* (2013.01); *A47F 5/0846* (2013.01); *A47F 5/0876* (2013.01); *A47F 7/143* (2013.01)

(58) Field of Classification Search

CPC ..... A47K 10/10; A47K 10/12; A47K 10/04; A47F 5/0876; A47F 5/0815; A47F 1/128; A47F 7/00; A47F 7/143; A47F 5/0006; A47F 5/08; A47G 25/0614; A47G 25/0607; A47G 25/06

USPC ..... 248/307

See application file for complete search history.

(56) References Cited

U.S. PATENT DOCUMENTS

| | | | | | |
|---|---|---|---|---|---|
| 683,248 | A * | 9/1901 | Chase | A47G 25/0678 | 248/223.41 |
| 1,055,201 | A * | 3/1913 | Mason | A47B 57/567 | 248/222.51 |
| 1,182,702 | A * | 5/1916 | Niles | F16M 11/04 | 248/307 |
| 1,294,916 | A * | 2/1919 | Knight | A47B 96/061 | 248/215 |
| 1,380,747 | A * | 6/1921 | Stanford | A47G 29/10 | 211/1 |
| 1,755,453 | A * | 4/1930 | Mullen | E04D 13/0722 | 248/48.1 |
| 1,996,552 | A * | 4/1935 | Schwender | A47B 61/003 | 211/100 |

(Continued)

*Primary Examiner* — Devin K Barnett
(74) *Attorney, Agent, or Firm* — Frank H. Foster; Kremblas & Foster

(57) ABSTRACT

A vertically adjustable holder for a domestic article such as a towel provides an easy way to adjust the height of the domestic article to accommodate the height of a child. It has a base that can be mounted to a wall such as by anchor screws or hung from a door of a building such as by hooks that extend over the top of the door. A movable support is attached to the base and is manually vertically adjustable with respect to the base. The movable support is also fixable in position on the base at a selected vertical position. An article supporting fixture is attached to the movable support to hang or otherwise retain the domestic article on the fixture and to permit vertical adjustment of the fixture's height above a floor that is below the fixture when the base is mounted to a wall or door.

2 Claims, 4 Drawing Sheets

(56) References Cited

U.S. PATENT DOCUMENTS 2,681,194 A * 6/1954 Halvorsen ..... A47G 1/1626 248/490
2,928,512 A * 3/1960 Slater ..... F16B 37/045 403/22
2,931,612 A * 4/1960 Graber ..... A47H 13/04 248/307
3,237,898 A * 3/1966 Goss ..... A47G 1/215 248/478
4,149,692 A * 4/1979 Califano ..... F16M 11/046 248/225.11
5,014,948 A * 5/1991 Asaro ..... A47B 96/16 211/104
5,197,705 A * 3/1993 Baskas ..... A47G 29/08 248/905
5,356,104 A * 10/1994 Rosenberg ..... A47F 5/0846 248/225.11
D380,325 S * 7/1997 Kempf ..... D6/567
5,809,607 A 9/1998 Elson et al.
6,105,794 A * 8/2000 Bauer ..... A47B 96/063 211/208
6,273,279 B1 * 8/2001 Wolf ..... A63B 55/408 24/372
6,349,911 B1 * 2/2002 Feldpausch ..... A47B 57/34 248/250
6,390,433 B1 * 5/2002 Kasa-Djukic ..... A47B 97/04 248/458
6,783,011 B2 * 8/2004 Rodrigue ..... A47F 5/0876 248/214
7,234,671 B2 * 6/2007 Avinger ..... A01G 5/04 248/339
7,320,452 B2 * 1/2008 Chen ..... A47F 5/0846 248/301
7,578,492 B2 * 8/2009 Darre' ..... A47G 1/202 248/217.4
7,698,789 B2 4/2010 Cserpes
D657,054 S * 4/2012 Bacon ..... D24/128
8,534,627 B2 * 9/2013 Kressin ..... A47G 1/20 248/323
8,596,590 B2 * 12/2013 McCoy ..... F16M 13/02 248/68.1
8,672,286 B2 * 3/2014 Darre ..... A47G 1/164 33/666
9,706,898 B1 7/2017 Kraft
9,955,776 B2 5/2018 Terry
10,039,394 B2 * 8/2018 Pyle ..... A47G 1/10
10,342,393 B1 7/2019 Kirkpatrick
10,458,594 B2 * 10/2019 Burton ..... A47G 1/205
10,537,192 B2 * 1/2020 Fastermann ..... A47G 1/202
11,248,741 B1 * 2/2022 Parniani ..... A01G 5/04
11,707,145 B2 * 7/2023 Johnson ..... A47K 3/281 211/30
2003/0029986 A1 * 2/2003 Zuller ..... A47G 1/164 248/476
2006/0049124 A1 * 3/2006 Wang ..... A47B 43/003 211/113
2006/0214080 A1 * 9/2006 de Keratry ..... A47G 1/202 248/495
2008/0135701 A1 * 6/2008 Smith ..... E04F 21/1855 248/295.11
2008/0185353 A1 * 8/2008 Immerman ..... A47G 25/743 211/16
2010/0300994 A1 * 12/2010 Turner-Wiltshire ... A47K 10/10 211/16
2012/0003419 A1 1/2012 Xue
2012/0228440 A1 * 9/2012 Jahnke ..... F16M 11/10 248/125.1
2013/0071597 A1 3/2013 Tvelil
2014/0054440 A1 2/2014 Cardie et al.
2014/0284439 A1 9/2014 Biagiotti
2019/0142197 A1 * 5/2019 Mcclendon ..... A47B 61/02 248/295.11
2022/0369869 A1 11/2022 Mears

* cited by examiner

VERTICALLY ADJUSTABLE SUPPORT FOR A TOWEL OR OTHER DOMESTIC ARTICLE TO ACCOMMODATE A CHILD'S GROWTH IN HEIGHT

BACKGROUND OF THE INVENTION

In order to facilitate the convenient availability of personal health and hygiene products, a variety of holders for supporting such products are commonly mounted to the walls of domestic bathroom facilities within easy reach of the people who use those products. A typical and important example is the mounting of towel bars, hooks, rings or other fixtures on facility walls for supporting a towel, washcloth or other domestic articles in a fixed wall position near the location where it is normally retrieved for use and conveniently replaced after use.

However, the fixtures are typically permanently mounted to the wall at a selected height above the floor. That height above the floor is usually selected to conveniently accommodate adults but is out of the reach of small children. In order to teach and enable small children to be self-sufficient, it is desirable to position their personal domestic articles, especially towels, low enough to be within the small child's easy reach. Additionally, people with some physical disabilities, such as may result from an injury or surgery, may have difficulty reaching up high enough to grasp a towel or other domestic article that is positioned at a customary height.

Of course it is usually possible to detach the fixtures from their original position and remount them at a height above the floor that accommodates a small child. Unfortunately, removing a fixture from one wall location and remounting it at a lower wall location requires removing the fasteners by which the fixture was attached to the wall. When a fixture is relocated, the original fastener holes in the wall are visible and deface the décor of the room or require a repair effort or both. Therefore, although possible, it is not practical to move the position of the fixture.

In addition to the lack of practicality of relocating a fixture, as children grow older they also grow in stature. Consequently, it would be desirable to have a vertically adjustable holder for domestic articles that can be used to raise the height of a fixture used by a child as the child becomes older and taller without causing unsightly blemishes to be displayed on a wall. But periodically and repeatedly removing fixture fasteners in order to raise the height of a fixture that is mounted directly to the wall would further deface the décor of the room or require a repair effort or both.

It would also be desirable to have a vertically adjustable holder for a domestic article that can be reused by a later born child who was born after an earlier child has sufficiently grown in height to have outgrown and discontinued their use of the holder without requiring any remounting on a wall or door.

It is therefore a purpose, object and feature of the invention to provide a vertically adjustable holder for a domestic article that overcomes the above deficiencies by allowing the height of a domestic article-supporting fixture to be adjusted without the need to remove and relocate fasteners or other mounting retainers that mount a fixture to a wall or door.

SUMMARY OF THE INVENTION

The invention is a vertically adjustable holder for a domestic article such as a towel. It has a base that is configured to enable it to be mounted to a wall such as by anchor screws or hung from a door of a building such as by hooks that extend over the top of the door. A movable support is attached to the base and manually vertically adjustable and also fixable with respect to the base at a selected vertical position. An article supporting fixture is attached to the movable support on which to hang or otherwise retain the domestic article. Raising or lowering the movable support vertically adjusts the fixture's height above a floor that is below the fixture when the base is mounted to a wall or door.

Figure 1:
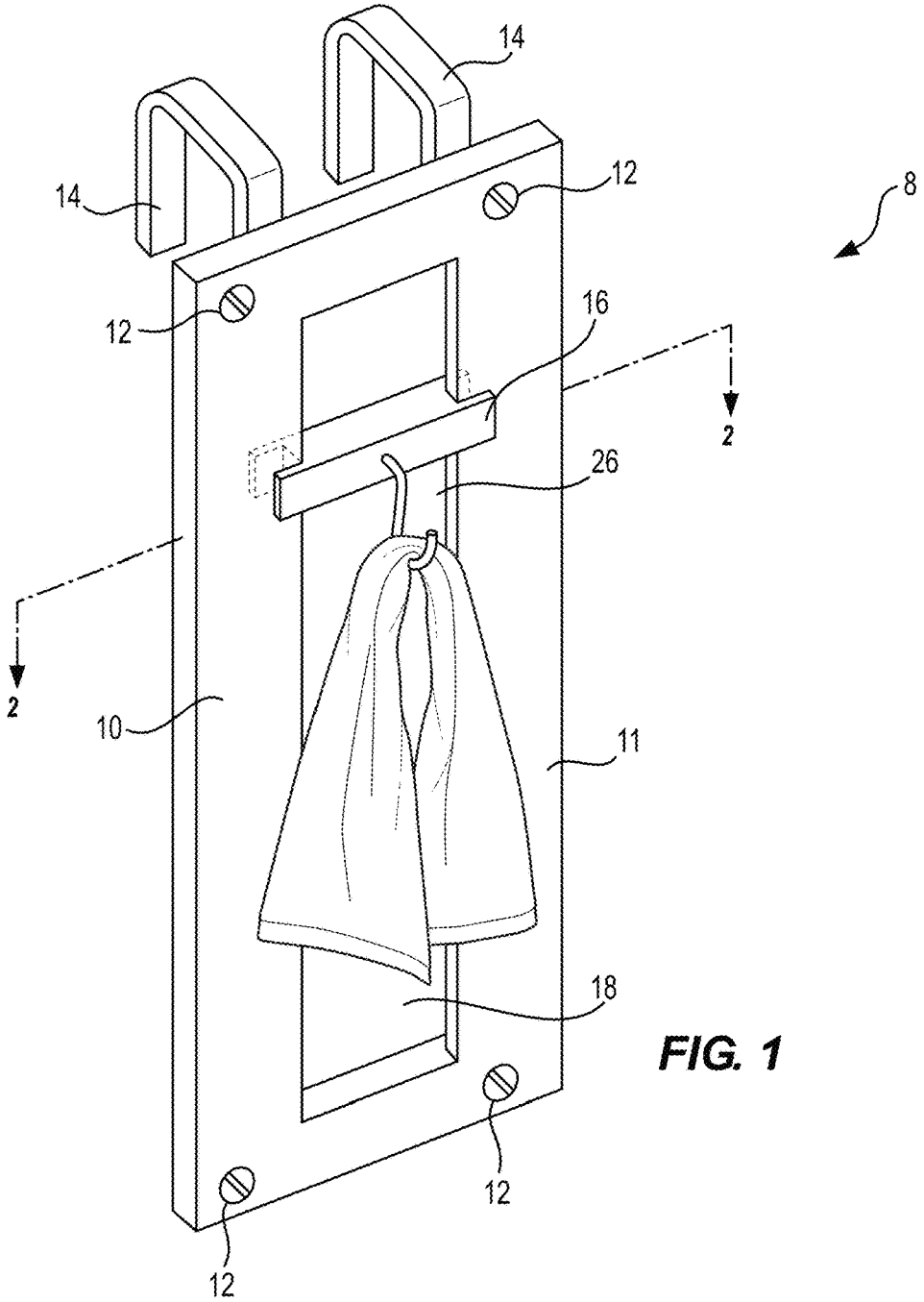
FIG. 1 is a view in perspective of a first example of an embodiment of the invention.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose.

DETAILED DESCRIPTION OF THE INVENTION

In describing the embodiments of the invention, directional words such as vertical, above, below, up and down are used. Such directional words refer to a direction when an embodiment of the invention is mounted in its operable orientation. Although the word "vertical" includes the preferred orientation of aligned along a radial of the earth, it also includes orientations that are offset from perfectly vertical but have a component that is vertical by an amount that does not eliminate the useful function and purpose of embodiments of the invention.

FIG. 1 illustrates a relatively simple, vertically adjustable, domestic article holder 8 that embodies the invention. The illustrated domestic article is a towel 11 but could be any of many other domestic articles such a wash cloth, an article of clothing or a bar of soap on a string. A domestic article is an object that is commonly used by people in their homes. Embodiments of the invention have a base, such as the base 10 shown in FIG. 1, which is configured to enable it to be mounted to a wall or door of a building. Preferably, the article holder 8 has at least one mounting retainer to attach the base 10 to a wall or door. For example, the base 10 can be mounted to a wall with anchor screws 12. Alternatively and illustrated in phantom, the article holder 8 can be hung from a door by hooks 14 that are attached to the rear side of the base 10 such as by screws or adhesive.

Figure 2:
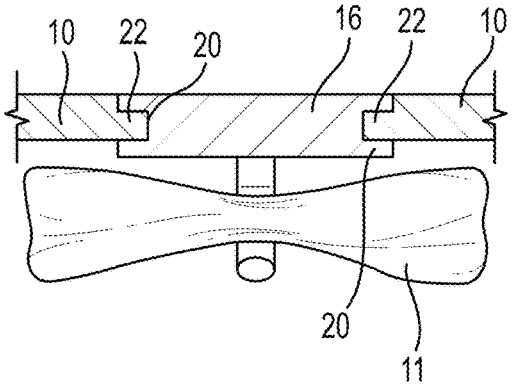
FIG. 2 is a view in horizontal section taken substantially along the line 2-2 of FIG. 1 and illustrating the frictional mounting of the movable support of FIG. 1 to allow height adjustment.

A movable support 16 is attached to the base 10 and is both manually vertically adjustable and fixable with respect to the base at a selected vertical position. For example, for the embodiment of FIG. 1 the movable support 16 is attached to the base 10 in frictional engagement within a vertical slot 18 in the base 10. Referring to FIG. 2, the movable support 16 has end slots 20 at its laterally opposite ends that receive ridges 22 formed in the sidewalls of the vertical slot 18. The movable support 16 has a lateral dimension that is equal to or slightly greater than the lateral distance between the ridges 22 to form a tight fit in the vertical slot 18. Alternatively, all or part of the movable support 16 can be formed of an elastic material that can expand to apply lateral forces against the sidewalls of the vertical slot 18. In any case, sufficient friction must be maintained between the vertical slot 18 sidewalls and the movable support 16 in order to hold the movable support 16 in a fixed position during normal use while allowing a user to slide the movable support 16 up or down using normal human strength, particularly the strength of a child.

An article supporting fixture 26 is attached to the movable support 16 and configured to retain the domestic article (11 in FIG. 1). The fixture, which is illustrated in FIG. 1, is a hook 26 that supports the domestic article 11. Sliding the movable support 16 up or down vertically adjusts the fixture's height above a floor, which is below the fixture when the base 16 is mounted to a wall or door.

All of the embodiments of the invention use a fixture of some kind to support the domestic article such as a towel. Not only can any of the article supporting fixtures, which are illustrated in the various embodiments shown in the drawings, be substituted on, or added to, other embodiments of the invention, but it should be apparent that other domestic article supporting fixtures that are known in the prior art can also be substituted on or added to embodiments of the invention. Common fixtures include hooks, clamps, pegs, rings and bars, especially horizontally mounted bars.

Figure 3:
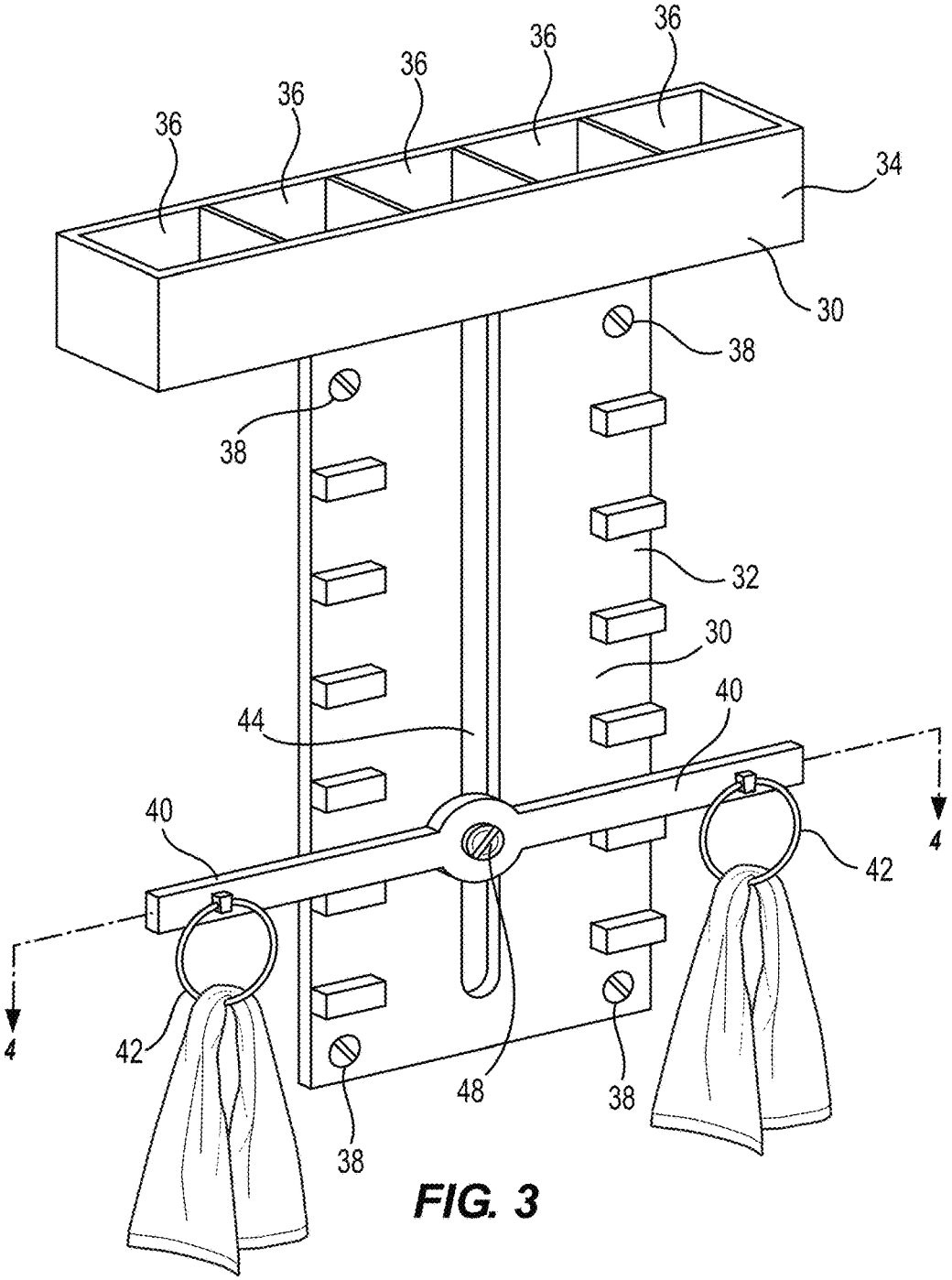
FIG. 3 is a view in perspective of another embodiment of the invention.

FIG. 3 illustrates an alternative embodiment of the invention. It has a base 30 which includes both a backboard 32 and a shelf 34, which are fixed together. The shelf 34 has multiple storage compartments 36 configured for storing domestic articles such as toothpaste, bars of soap or a handwashing dispenser. The backboard 32 of the base 30 can be attached to a wall by anchor screws 38. Of course, like all embodiments of the invention, the base 30 can be attached directly to a door by means of similar fasteners or alternatively be hung from a door by hooks like those illustrated in phantom in FIG. 1.

Figure 6:
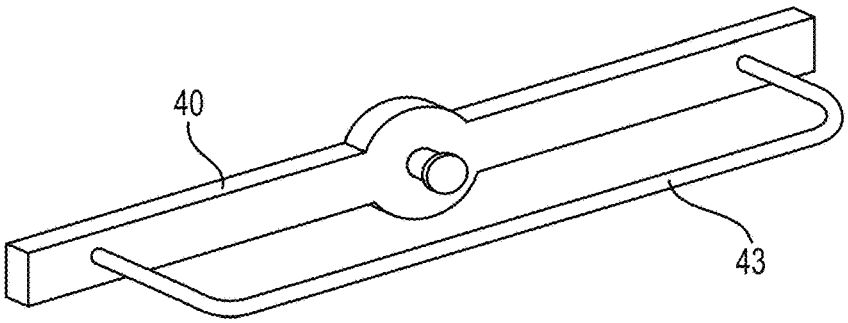
FIG. 6 is a view in perspective of a movable support like the movable support of FIG. 3 but having an article supporting fixture that is a towel bar.

A movable support 40 is attached to the backboard 32 of the base 30. The movable support 40 extends laterally or horizontally so that multiple, horizontally spaced, article-supporting fixtures 42 can be attached to the movable support 40. For example, the article-supporting fixtures 42 can be rings as illustrated in FIG. 3. The lateral length of the movable support 40 permits the mounting of several article supporting fixtures of the same or differing types. As illustrated in FIG. 6, the lateral length of the movable support 40 also permits the mounting of a horizontal towel bar 43 to the movable support 40 for supporting a domestic article.

The backboard 32 has a vertical slot 44 and a series of vertically spaced ledges 46. The movable support 40 rests upon at least one ledge 46 and preferably upon two that are spaced apart and positioned near laterally opposite sides of the backboard 32. The height of the movable support 40 is adjusted by a user pulling the movable support 40 away from the front surface of the backboard 32 by a distance sufficient to clear the outwardly protruding ledges 46, and then, while maintaining the pulled out position, sliding the movable support up or down past at least one ledge 46 to a desired height. When the desired height between ridges 46 is reached, the movable support 40 is released and slides down onto ledges 46.

Figure 4:
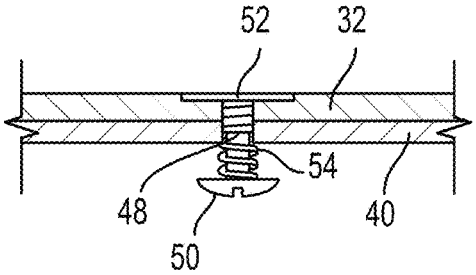
FIG. 4 is a view in horizontal section taken substantially along the line 4-4 of FIG. 3 illustrating the adjustable attachment of the movable support to the base of the embodiment of FIG. 3.

Referring to FIG. 4, in order to permit adjustment in that manner, a spring-loaded screw 48 extends outwardly from the front of the movable support 40 to a screw head 50. A nut 52 is threadedly engaged to the screw 48 and is slidable along the vertical slot 44 against a back surface of the backboard 32. A spring, such as a compression helical spring 54, extends between the screw head 50 and the front surface of the movable support 40. The screw 48 is long enough that its head 50 is spaced far enough in front of the front surface of the movable support 40 to allow the movable support 40 to clear and pass over the ledges 46 as the movable support 40 is simultaneously pulled and held out and then adjusted up or down.

Figure 5:
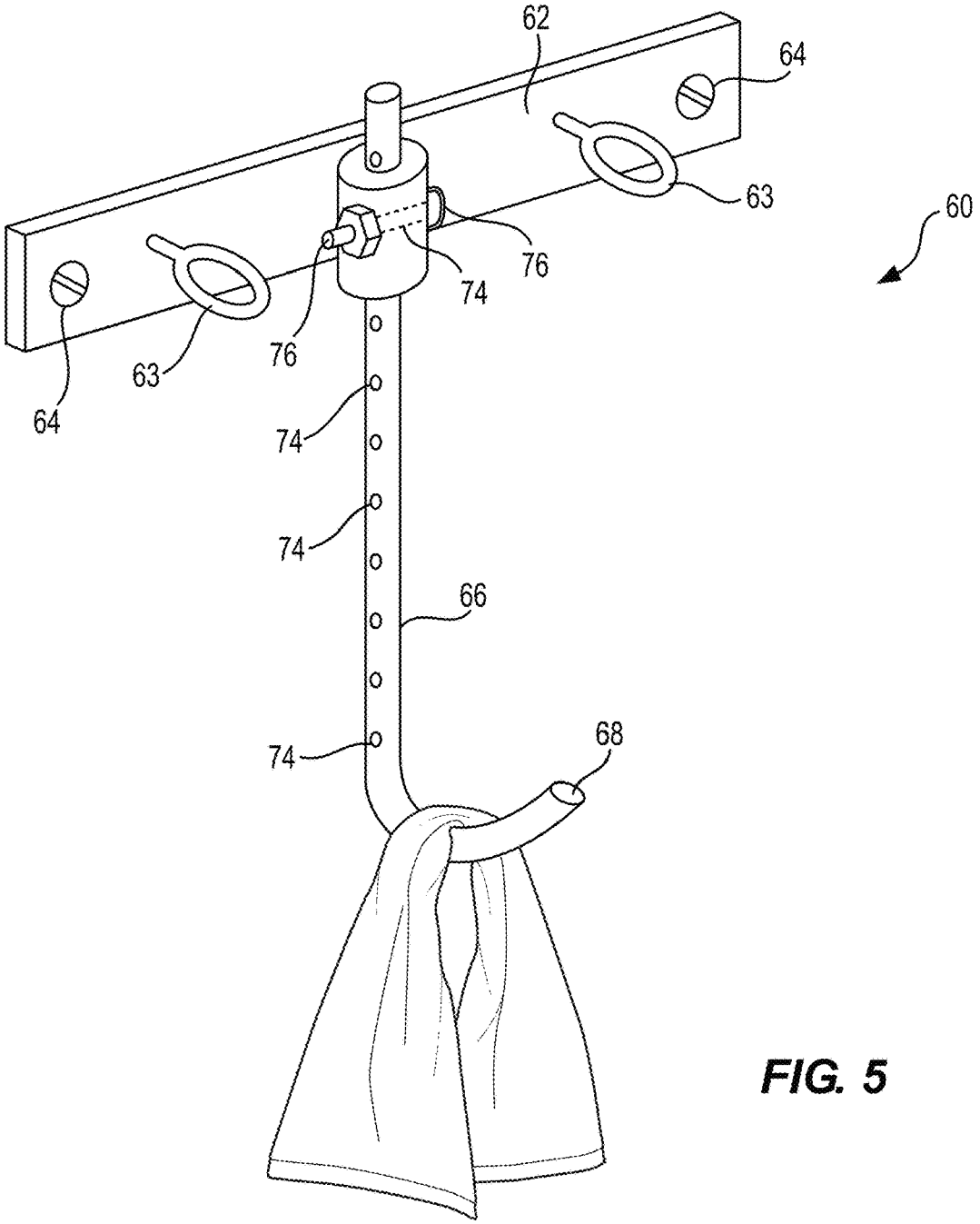
FIG. 5 is a view in perspective of yet another embodiment of the invention.

FIG. 5 illustrates yet another embodiment of the invention. The vertically adjustable holder 60 of FIG. 5 has a base 62 that is shown with anchor screws 64 for attaching it to a wall or a door. The base 62 may be provided with other fixtures, such as screw eyes 63 for supporting toothbrushes or other domestic articles The adjustable holder 60 also has a movable support that is a bar 66 oriented in a generally vertical direction. An article supporting fixture 68 is attached to the lower end of the bar 66 and is preferably in the form of an integrally extending hook 68. The upper portion of the bar 66 is manually vertically adjustable and fixable with respect to the base 62 at a selected vertical position. For its vertical adjustment, the upper portion of the bar 66 has a series of parallel bar holes 70 spaced longitudinally along its length.

A collar 72 is fixed to the base 62 and can be considered a part of the base 62. The collar 72 surrounds the bar 66 and has a diameter that allows the bar 66 to slide along inside the collar 72. The collar 72 has a collar hole 74 that registers with the bar holes 70 as the bar 66 is slid up and down within the collar 72. A pin, such as a machine screw, is insertable through the collar hole 74 and a selected bar hole 70 when a bar hole 70 is slid into registration with the collar hole 74 for fixing the vertical height of the bar 66.

The article supporting fixture 68 of the vertically adjustable holder 60 shown in FIG. 5 is conveniently raised or lowered by removing the machine screw 76 or other pin, sliding the bar 66 to bring a selected hole 70 in the bar 66 into registration with the collar hole 74 and then replacing the machine screw 76 or other pin.

Figure 7:
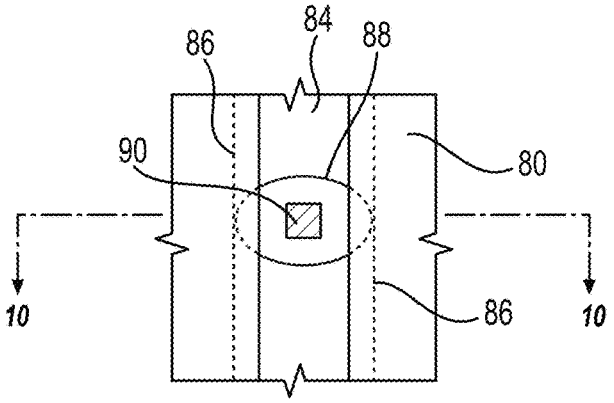
FIG. 7 is a segmental view in vertical section taken substantially along the line 7-7 of FIG. 10 of an alternative eccentric structure for attaching a movable support to a base in a manner that is manually vertically adjustable and also fixable with respect to the base at a selected vertical position and showing it locked in a fixed position.
Figure 8:
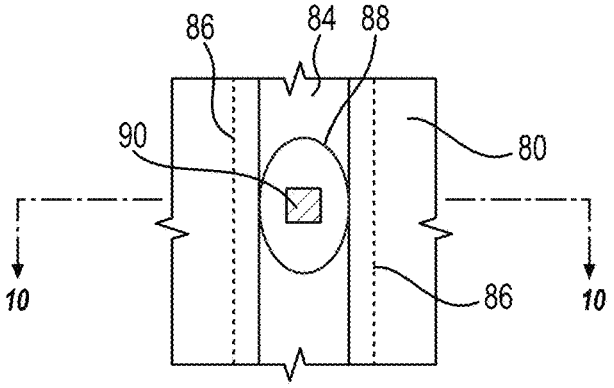
FIG. 8 is a segmental view in vertical section taken substantially along the line 7-7 of FIG. 10 showing the structure of FIG. 7 in a released, slidable, vertically adjustable position.
Figure 9:
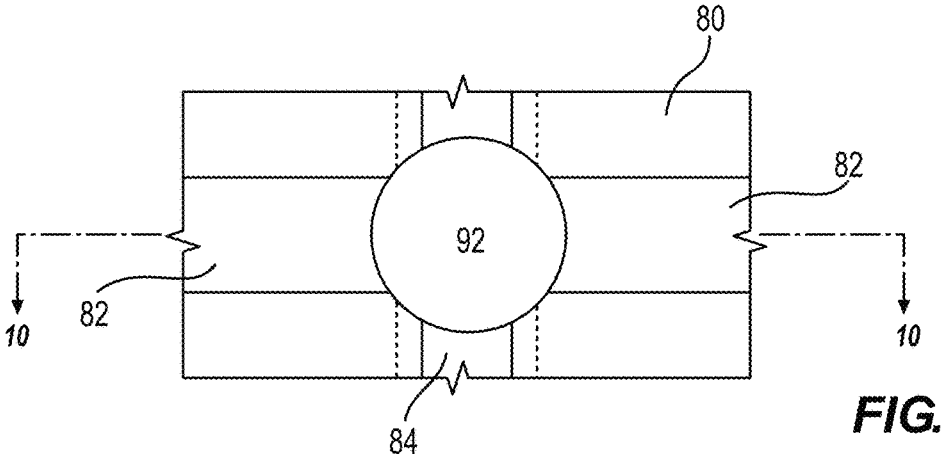
FIG. 9 a segmental front view of the structure of FIG. 7.
Figure 10:
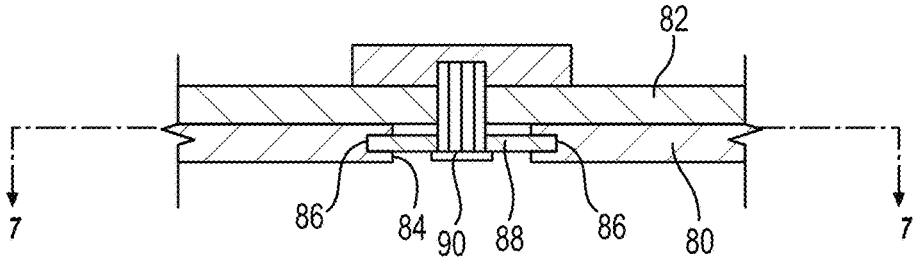
FIG. 10 is a segmental view in horizontal section of the structure of FIG. 7 taken substantially along the line 10-10 of FIGS. 7, 8 and 9.

FIGS. 7 through 10 illustrate an example of another alternative latching structure that may be used for vertically adjusting a movable support as part of an embodiment of the invention in way that its article supporting fixture can be manually vertically adjusted to selected heights and then sufficiently rigidly fixed to a base that is will remain in position during normal use. FIGS. 7 through 10 are segmental in the sense that they show only a segment of an embodiment that is sufficiently large to illustrate the structure and operation of the alternative latching structure. FIGS. 7 through 10 show a base 80, such as a backboard, and a movable support 82 in interfacing contact. The base 80 has a vertical slot 84 with a longitudinal channel 86 formed into and running along both of the sidewalls of the vertical slot 84. An eccentric or elliptical wheel 88 is rotatable so that its peripheral edge can be rotated to seat against a surface of both sidewalls of the slot 84 as shown in FIG. 7, preferably within the vertical slots 84. The wheel 88 is also rotatable so that its peripheral edge is withdrawn from contact with the slot 84 sidewalls, as shown in FIG. 8, to allow the height of the movable support 84 to be vertically adjusted. The wheel 88 is fixed to one end of an axle 90 and fixed to a release knob 92 at the opposite end of the axle 90. The axle 90 extends through a hole in the movable support 82 and is rotatable within the hole. With this latching structure, rotation of the knob 92 allows the manual vertical adjustment of the movable support 82 by withdrawing the edge of the wheel from the sidewall of the slot 84. It also allows further rotation of the knob 92 to fix the movable support 82 with respect to the base 80 at a selected vertical position. It is also possible to interchange the relative locations of the wheel and other components between the movable support and the base.

REFERENCE NUMBERS

FIGS. 1 and 2
8 article holder
10 base
11 towel
12 anchor screw
14 hooks to hang on door
16 movable support
18 vertical slot
20 end slots of movable support
22 ridges
26 article supporting fixture
FIGS. 3, 4 and 6
30 base
32 backboard
34 shelf
36 storage compartments
38 anchor screws
40 movable support
42 multiple supporting fixtures
43 horizontal towel bar
44 vertical slot
46 vertically spaced ledges
48 spring loaded screw
50 screw head
52 nut
54 spring
FIG. 5
62 base
63 screw eyes for tooth brushes
64 anchor screws
66 movable support
68 fixture-bar
70 holes
72 collar
74 collar hole
76 pin-machine screw
FIGS. 7-10
80 base
82 movable support
84 vertical slot
86 channel
88 eccentric or elliptical wheel
90 axle
92 release knob This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. A vertically adjustable holder for a domestic article, the holder comprising:

(a) a base configured to be mounted to a wall or door of a building, the base being a flat panel backboard with a vertical slot, the vertical slot having ridges (22) extending laterally from each opposite side of the vertical slot, each ridge having a ridge thickness defined by a distance between opposite sidewalls of the ridge;

(b) a movable support attached to the base and manually vertically adjustable and fixable with respect to the base at a selected vertical position, wherein the movable support is a laterally extending crossbar (16) with end slots (20) at each end, the end slots each having opposite sidewalls that are spaced apart by the ridge thickness, the ridges (22) seating against and frictionally engaging the slots in the movable support, and wherein the movable support 16 has a lateral dimension that is equal to or slightly greater than the lateral distance between the ridges (22) to form a tight fit in the vertical slot (18); and (c) an article supporting fixture attached to the movable support and configured to retain the domestic article and to permit vertical adjustment of the fixture's height above a floor, which floor is below the fixture when the base is mounted to a wall or door.

2. The vertically adjustable holder according to claim 1 wherein the base further comprises at least one mounting retainer in the form of at least one fastener to attach the base to a wall or door or a hook to hang the base from a top of a door.

* * * * *